US005479101A

United States Patent [19]

Chang

[11] Patent Number: 5,479,101

[45] Date of Patent: Dec. 26, 1995

[54] IGNITION COIL TESTER FOR TESTING A VEHICLE ENGINE IGNITION COIL

[76] Inventor: Tony H. Chang, P.O. Box 970, Alcoa, Tenn. 37701

[21] Appl. No.: 271,035

[22] Filed: Jul. 6, 1994

[51] Int. Cl.[6] ..... F02P 17/00

[52] U.S. Cl. ..... 324/388; 324/546

[58] Field of Search ..... 324/388, 402, 324/546, 556

[56] References Cited

U.S. PATENT DOCUMENTS 4,186,337 1/1980 Volk et al. ..... 324/380
4,886,029 12/1989 Lill et al. ..... 324/380 X
5,097,815 3/1992 Oota et al. ..... 123/606
5,196,798 3/1993 Baeza et al. ..... 324/388
5,399,972 3/1995 Hnat et al. ..... 324/399

*Primary Examiner*—Kenneth A. Wieder
*Assistant Examiner*—Glenn W. Brown
*Attorney, Agent, or Firm*—Pitts & Brittain

[57] ABSTRACT

An ignition coil tester for testing ignition coils associated with motor vehicles. The ignition coil tester includes an oscillator for simulating an output signal from the ignition module associated with the ignition coil being tested. A short circuit detector is provided for detecting a short circuit within the ignition coil. An open coil indicator is proved for indicating an open circuit within the ignition coil. A series of visual indicators are provided for indicating the strength of a signal being output by the ignition coil.

10 Claims, 3 Drawing Sheets

IGNITION COIL TESTER FOR TESTING A VEHICLE ENGINE IGNITION COIL

TECHNICAL FIELD

This invention relates to the field of automobile repair. More specifically, the present invention is related to a device for testing the ignition coil associated with a vehicle engine.

BACKGROUND ART

In the field of automobile repair, it is well known that detecting a problem with an ignition coil may be difficult. Typically, problems that may arise within the ignition coil include a short circuit or a broken coil wire. While commercial devices are available to professional mechanics, there are no testing devices available for an individual who prefers to repair his own vehicles.

Alternatively, it is known that some automobile parts stores use devices similar to those found in repair shops such that an individual may bring in an ignition coil to be tested. This obviously requires the removal of the ignition coil from the automobile. In the event the tester is used at a parts retailer, if the ignition coil is not in need of replacement or repair, then it is re-installed in the automobile. In that case, further investigation must be made to determine the cause of the problem. Due to the difficulties involved in testing an ignition coil, it is often replaced whether or not it is faulty. This can be an expensive alternative.

Hence, it is desirable to have a device which may be used for testing ignition coils which is easily affordable. Further, it is desirable to provide a testing device which more accurately and dynamically tests the integrity of ignition coils when compared to conventional devices.

Therefore, it is an object of this invention to provide a device for testing automobile ignition coils whereby the device is inexpensively manufactured.

Further, it is an object of the present invention to provide such a device whereby greater accuracy is attained over testing devices of the prior art.

DISCLOSURE OF THE INVENTION

Other objects and advantages will be accomplished by the present invention which serves to test an ignition coil associated with a vehicle motor. The ignition coil tester includes an oscillator for simulating an output signal similar to that of the ignition module associated with the ignition coil. A power supply is activated upon closing an ON/OFF switch, which supplies power to the oscillator. An LED is provided for indicating when the power to the ignition coil tester is ON.

Upon closing a TEST switch, power is delivered to the ignition coil to be tested. If a break in the coil wire is detected, a green LED will not be illuminated. If a short circuit in the coil is detected, a red LED is illuminated. If these defects are not present in the coil, then the coil produces an output signal. The strength of the signal is indicated by a series of neon lamps. A weaker signal will cause fewer of the neon bulbs to illuminate as compared to a stronger signal.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An ignition coil tester incorporating various features of the present invention is illustrated generally at 10 in the figures. The ignition coil tester 10 is designed for quickly, dynamically and accurately testing the functionality of a vehicle ignition coil. Moreover, in the preferred embodiment the ignition coil tester 10 is designed to be portable and economical.

Figure 1:
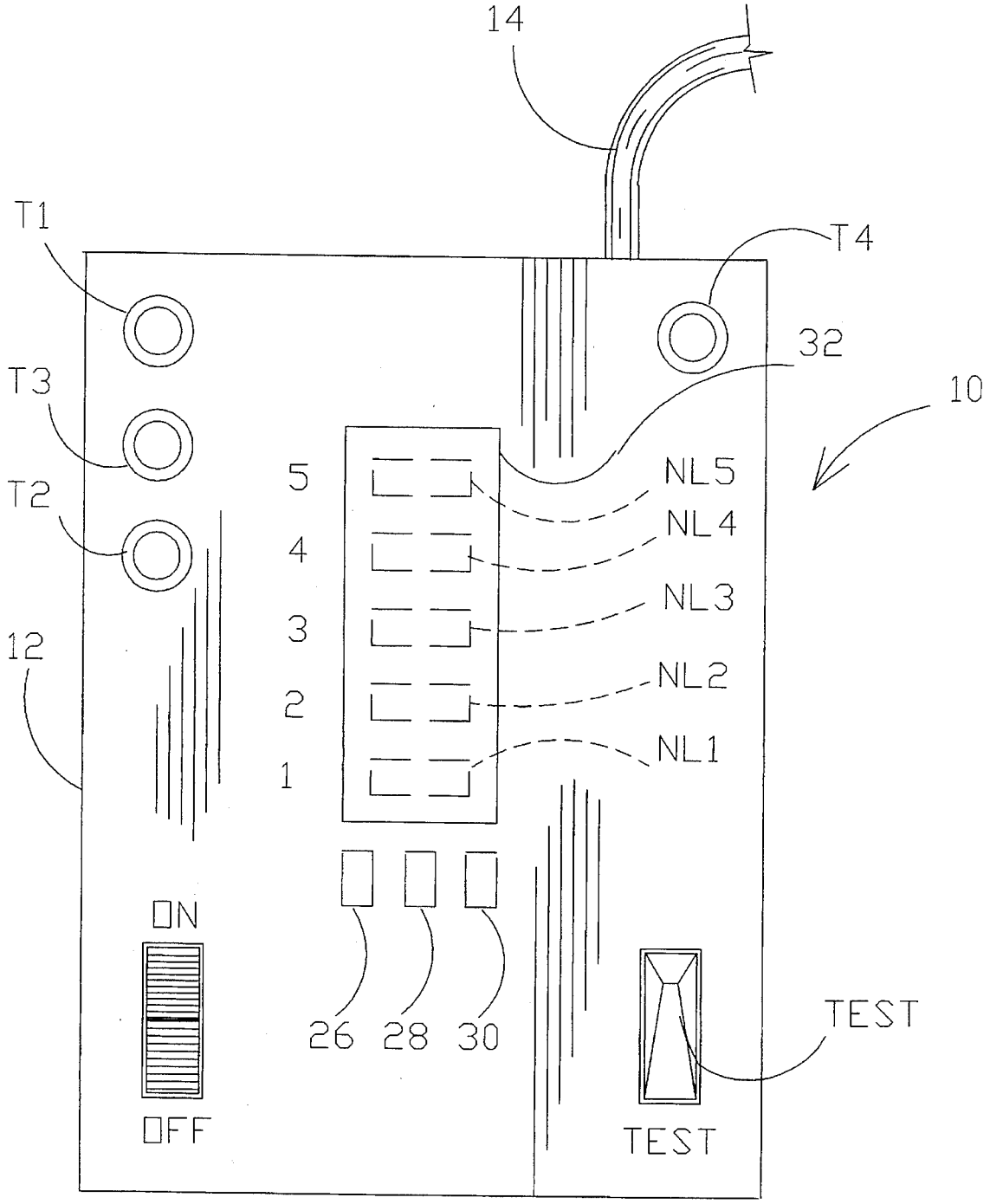
FIG. 1 is a top plan view of the ignition coil tester constructed in accordance with several features of the present invention.

FIG. 1 illustrates a preferred embodiment of the ignition coil tester 10 of the present invention. As illustrated, the circuitry associated with the present invention is contained within a housing 12, with terminals T1–T4 being provided for making appropriate electrical connections. A.C. power is supplied through a power cord 14. An ON/OFF switch for activating the ignition coil tester 10 is carried by the housing 12. A TEST switch is provided for initiating a new test. An indicator such as the illustrated LED 26 is provided for indicating when power is being supplied to the ignition coil tester 10. Two indicators such as the illustrated LED's 28,30 are provided for indicating an open circuit or a short circuit in the ignition coil 54. A series of indicators such as the illustrated neon lamps NL1-5 is provided for indicating the strength of the signal being output by the ignition coil 54.

Figure 2:
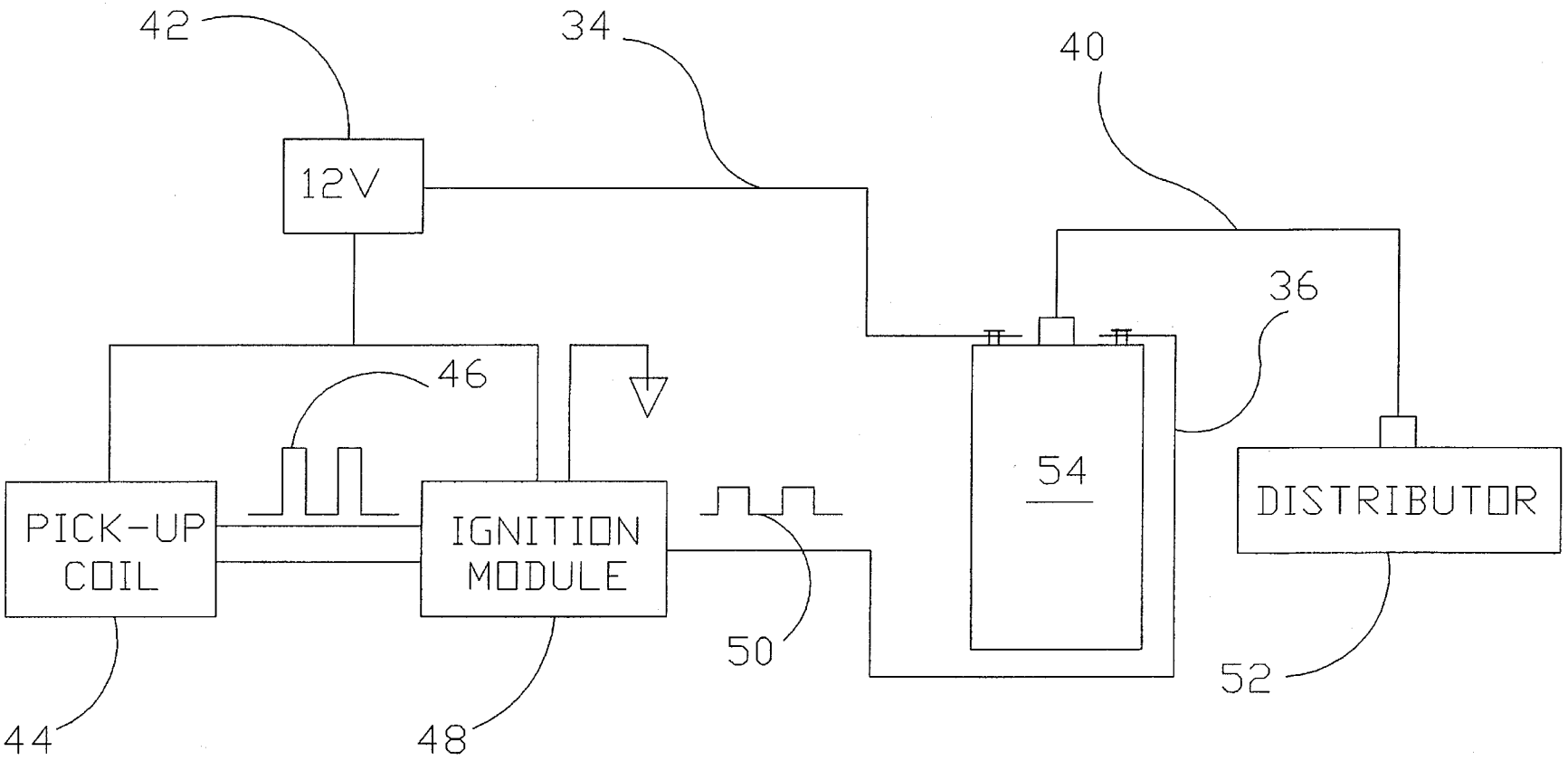
FIG. 2 is a schematic diagram of a typical vehicle ignition coil shown in electrical connection for standard operation.
Figure 3:
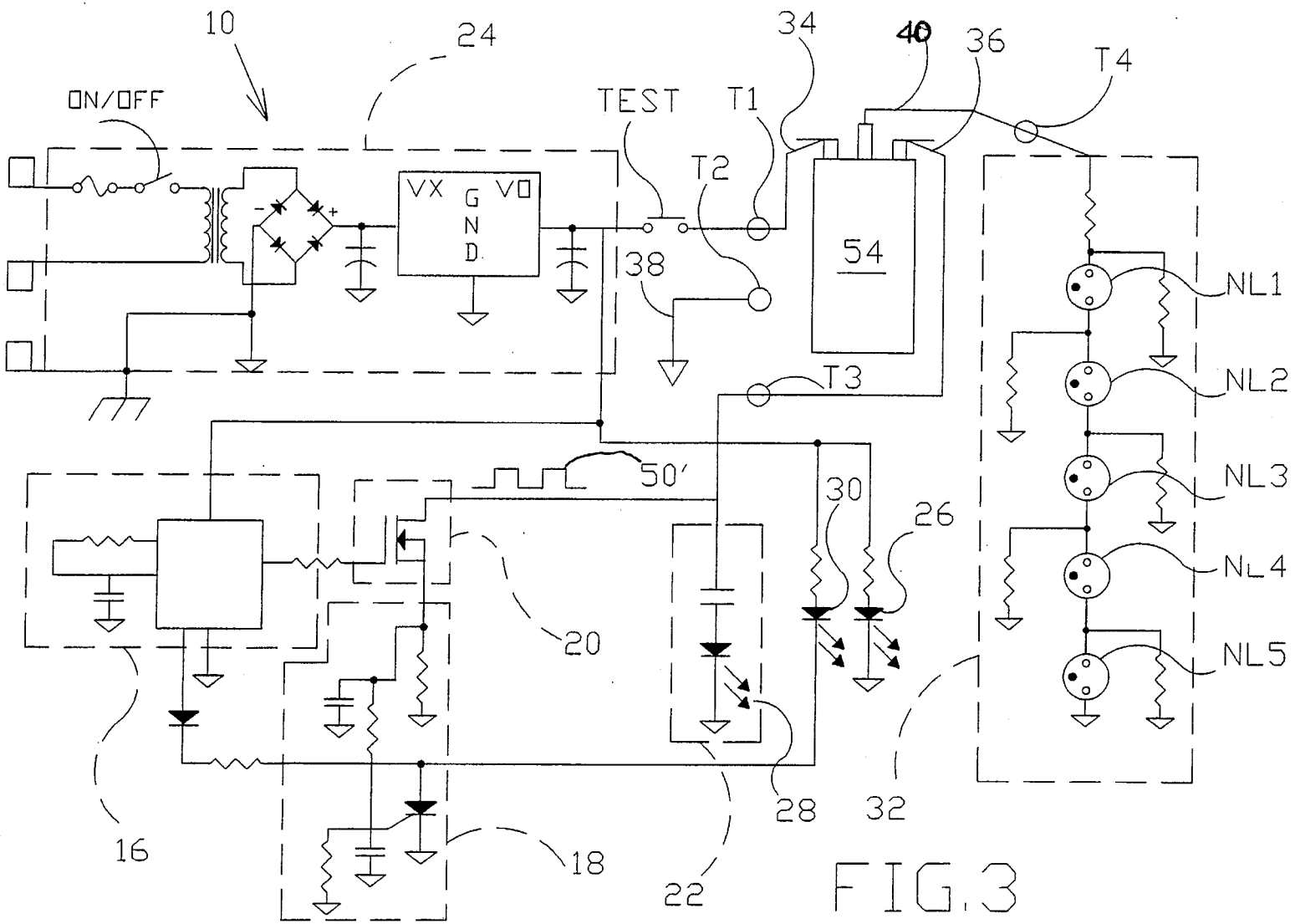
FIG. 3 is a schematic diagram of the electrical circuitry of the present invention shown in relation to a conventional ignition coil to be tested.

FIG. 2 schematically illustrates a conventional vehicle ignition coil 54 in electrical connection with the various electrical components of the vehicle engine (not shown). A pick-up coil 44 is electrically connected to the ignition module 48 which then outputs to the ignition coil 54. The signal 46 output from the pick-up coil 44 is depicted as a pulsed square wave. The ignition module output signal 50 is also in the form of a square wave. The ignition module 48 and the ignition coil 54 are driven by the vehicle battery 42 which typically supplies $12^{v}$. The output from the ignition coil 54 is routed to the distributor FIG. 3 illustrates a schematic diagram of the circuitry associated with the ignition coil tester 10 of the present invention, wherein the output signal 50 from the ignition module 48 is simulated using a signal generator 16, such as the illustrated oscillator. A power source 24 is provided to convert A.C. power to D.C. such that the vehicle battery is obviated and to power at least a signal generator 16 and the ignition coil 54 to be tested.

When the ON/OFF switch is in the ON position, power is delivered to the oscillator 16. A TEST switch is provided for closing the circuitry including the ignition coil 54 to be tested. The TEST switch therefore provides a safety feature whereby the proper connections may be made and the power turned ON prior to power being delivered to the ignition coil 54.

In order to electrically connect the ignition coil tester 10 of the preferred embodiment to an ignition coil 54 to be tested, as illustrated, terminal T1 is connected through a connector wire 34 to the terminal on the ignition coil 54 at which the battery 42 is typically connected. Terminal T3 is connected in similar fashion through lead wire 36 to the terminal on the ignition coil 54 at which the ignition module 48 is typically connected. A lead wire 38 is connected between terminal T2 and the ground terminal (not shown) on the ignition coil 54. Finally, Terminal T4 is in electrical connection with the output terminal, typically in electrical communication with the vehicle distributor 52, via the ignition coil 54 through lead wire 40.

After the proper electrical connections have been made, and the power switch has been turned ON, a visual indicator such as the LED illustrated will be illuminated. In the preferred embodiment, the LED 26 glows yellow to avoid confusion with the visual indicators, such as the LED's 28,30 illustrated for displaying the condition of the ignition coil 54. The latter disclosed LED's preferably glow green and red, respectively.

After the power has been turned ON, the TEST switch is engaged to initiate a test of the ignition coil 54. If the LED 28 (green) is not illuminated and the LED 30 (red) is illuminated, then the ignition coil is detected as having a short and therefore needing to be replaced. If neither of the LED's 28,30 is illuminated, then either the electrical connections are improper or the circuit within the ignition coil 54 is open, as detected by the open coil detector 22. Finally, if the LED 28 (green) is illuminated and the LED 30 (red) is not illuminated, then the ignition coil 54 is determined to be good and the strength of the output signal therefrom is displayed by a series of indicators NL1-5 through a window In the preferred embodiment, each indicator NL is a neon lamp. As shown, the current into the first indicator NL1 is divided, as is the current delivered to each successive indicator NL2-5. If only the indicator NL1 is illuminated, then the ignition coil output signal is considered weak. However, if each indicator NL1-5 is illuminated, then a strong ignition coil signal is being output and the ignition coil is deemed good. Of course, more or fewer than five indicators NL may be incorporated for various applications of the present invention.

As disclosed, the LED 30 (red) indicates that there is a short circuit within the ignition coil 54. This event is detected by the short circuit detector circuitry 18. When a short circuit is detected, the switch indicated at 20 is tripped to prevent damage to the ignition coil tester 10 of the present invention.

In order to provide a more accurate test than conventional testing devices, the oscillator 16 of the preferred embodiment has a seventy-five percent (75%) duty cycle which allows for higher resolution for the detection of intermittent problems, including any minor defects. Further, the oscillator 16 of the preferred embodiment operates at a frequency of approximately equal to the output frequency of the ignition module 48 associated with a vehicle operating at 150 MPH. A preferred operating frequency of the oscillator 16 is approximately 500 Hz.

After the desired testing has been performed, the ignition coil tester 10 is disconnected from the ignition coil 54. The ignition coil 54 is then either replaced or re-installed, depending upon the results of the tests.

From the foregoing description, it will be recognized by those skilled in the art that an ignition coil tester offering advantages over the prior art has been provided. Specifically, the ignition coil tester serves to accurately determine whether or not an ignition coil is defective. Further, the ignition coil tester, due to the nature of the circuitry and hardware components, is easily portable and is relatively inexpensive to manufacture and therefore purchase. Hence, the ignition coil tester of the present invention is a device which can easily be afforded and used by the general public. Further, the ignition coil tester of the present invention provides an increased accuracy over conventional ignition coil testers used by professional mechanics and automobile parts suppliers. Specifically, the ignition coil tester of the present invention serves to detect a short circuit or an open circuit within the ignition coil, and further to indicate the signal strength of any output signal from the ignition coil.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An ignition coil tester for testing a vehicle engine ignition coil, the ignition coil being associated with an ignition module, from which an input signal is received in a pulsed square wave form, each of the ignition module and the ignition coil being powered by a direct current battery, said ignition coil tester comprising:

a signal generator including an electrical terminal for electrical connection thereof to the ignition coil and an oscillator for producing an ignition coil input signal emulating the input signal from the ignition module;

short circuit detector circuitry in electrical communication with said oscillator for detecting a short circuit within the ignition coil;

an open coil detector in electrical communication with said oscillator for detecting an open circuit within the ignition coil;

a power supply for supplying power to said signal generator and the ignition coil; and at least one indicator in electrical communication with each of said oscillator and said short circuit detector circuitry for indicating a condition of the ignition coil, said at least one indicator including a plurality of visual indicators in series one with another and separated by current dividers, the strength of a signal output from the ignition coil being determined by a number of said plurality of visual indicators being illuminated.

2. The ignition coil tester of claim 1 wherein said signal generator is an oscillator.

3. The ignition coil tester of claim 1 wherein said ignition coil input signal is modulated at a frequency substantially twice the frequency of the input signal received from a pick-up coil associated with the ignition module.

4. The ignition coil tester of claim 1 wherein said at least one indicator includes a second plurality of visual indicators including a first visual indicator for indicating a non-defective ignition coil and a second visual indicator for indicating a defective ignition coil, said first visual indicator being illuminated when an open circuit is not detected by said open coil detector, said second visual indicator being illuminated when a short circuit is detected by said short circuit detector circuitry.

5. The ignition coil tester of claim 1 further comprising a test switch for initiating a test of the ignition coil.

6. An ignition coil tester for testing a vehicle engine ignition coil, the ignition coil being associated with an ignition module, from which an input signal is received in a pulsed square wave form, each of the ignition module and the ignition coil being powered by a direct current battery, said ignition coil tester comprising:

an oscillator including an electrical terminal for electrical connection thereof to the ignition coil for producing an ignition coil input signal emulating the input signal from the ignition module;

short circuit detector circuitry in electrical communication with said oscillator for detecting a short circuit within the ignition coil;

an open coil detector in electrical communication with each of said oscillator and said short circuit detector circuitry for detecting an open circuit within the ignition coil;

a power supply for supplying power to said oscillator and the ignition coil;

a first visual indicator in electrical communication with each of said oscillator and said short circuit detector circuitry for indicating a non-defective ignition coil, said first visual indicator being illuminated when an open circuit is not detected by said open coil detector;

a second visual indicator in electrical communication with each of said oscillator and said short circuit detector circuitry for indicating a defective ignition coil, said second visual indicator being illuminated when a short circuit is detected by said short circuit detector circuitry;

a plurality of signal strength indicators including an electrical terminal for electrical connection thereof to the ignition coil for visually displaying a representation of the strength of a signal output from the ignition coil, said plurality of signal strength indicators being in series one with another and separated by current dividers, said strength of said signal output from the ignition coil being determined by a number of said plurality of visual indicators being illuminated; and a test switch for initiating a test of the ignition coil.

7. The ignition coil tester of claim 6 wherein said ignition coil input signal is modulated at a frequency substantially twice the frequency of the input signal received from a pick-up coil associated with the ignition module.

8. An ignition coil tester for testing a vehicle engine ignition coil, the ignition coil being associated with an ignition module, from which an input signal is received in a pulsed square wave form, each of the ignition module and the ignition coil being powered by a direct current battery, said ignition coil tester comprising:

an oscillator including an electrical terminal for electrical connection thereof to the ignition coil for producing an ignition coil input signal emulating the input signal from the ignition module;

short circuit detector circuitry in electrical communication with said oscillator for detecting a short circuit within the ignition coil;

an open coil detector in electrical communication with each of said oscillator and said circuit detector circuitry for detecting an open circuit within the ignition coil;

a power supply for supplying power to said oscillator and the ignition coil;

a first visual indicator in electrical communication with each of said oscillator and said short circuit detector circuitry for indicating a non-defective ignition coil, said first visual indicator being illuminated when an open circuit is not detected by said open coil detector;

a second visual indicator in electrical communication with each of said oscillator and said short circuit detector circuitry for indicating a defective ignition coil, said second visual indicator being illuminated when a short circuit is detected by said short circuit detector circuitry; and at least one signal strength indicator including an electrical terminal for electrical connection thereof to the ignition coil for visually displaying a representation of the strength of a signal output from the ignition coil, said at least one signal strength indicator includes a plurality of visual indicators in series one with another and separated by current dividers, said strength of said signal output from the ignition coil being determined by a number of said plurality of visual indicators being illuminated.

9. The ignition coil tester of claim 8 wherein said ignition coil input signal is modulated at a frequency substantially twice the frequency of the input signal received from a pick-up coil associated with the ignition module.

10. The ignition coil tester of claim 8 further comprising a test switch for initiating a test of the ignition coil.

* * * * *